United States Patent [19]

Werner

[11] Patent Number: 5,035,660

[45] Date of Patent: Jul. 30, 1991

[54] ECCENTRIC ELECTRICAL CABLE CONNECTING DEVICE

[75] Inventor: Walter M. Werner, Downingtown, Pa.

[73] Assignee: AMP Incorporated, Harrisburg, Pa.

[21] Appl. No.: 277,103

[22] Filed: Nov. 29, 1988

[51] Int. Cl.[5] ..... H01R 11/09

[52] U.S. Cl. ..... 439/796; 439/807

[58] Field of Search ..... 439/791, 794, 796–798, 439/807, 815, 863

[56] References Cited

U.S. PATENT DOCUMENTS 1,641,627 9/1927 Ericson ..... 439/796

2,590,789 3/1952 Noyes ..... 439/796

4,128,295 12/1978 Bunnell ..... 339/274

4,128,296 12/1978 Lauterbach et al. ..... 339/274

4,752,252 6/1988 Cherry et al. ..... 439/807

*Primary Examiner*—Paula A. Bradley

*Attorney, Agent, or Firm*—Allan B. Osborne

[57] ABSTRACT

A connecting device for securing a cable such as an electrical cable. More particularly, the connecting device includes a first cylindrical member having a laterally open groove rotatably positioned in an eccentrical bore of a second member. A passage, defined by the groove and bore, is decreased in diameter upon the relative rotation of the first and second members to compress and securely retain a cable positioned therein.

5 Claims, 3 Drawing Sheets

ECCENTRIC ELECTRICAL CABLE CONNECTING DEVICE

FIELD OF THE INVENTION

This invention relates to electrical cable connecting devices wherein a cable is secured by reducing the diameter of the passage into which the cable is inserted.

BACKGROUND OF THE INVENTION

U.S. Pat. No. 4,128,295 to Bunnell discloses an eccentric bore connecting device comprising rotatable male and female parts having conductor receiving bores extending therethrough. The bores are eccentric relative to the axis of rotation of the parts so that the opening defined by the bores is constricted when the parts are rotated relative to each other whereupon the inserted cable is drastically deformed, compressed and accordingly secured therein against withdrawing forces. During the rotation, the inner surfaces of both eccentric bores exert both a transverse shear and a rotational or torsional shear on the strands of the cable which cause the individual strands to first compact and then to deform. Scraping action between strands scrapes off oxide coating where the cable is of aluminum, thus resulting in an enhanced electrical connection.

It is now proposed to provide an electrical cable connecting device wherein the cable is secured by eccentric bores but without subjecting the cable to transverse shear.

SUMMARY OF THE INVENTION

According to the present invention an electrical cable connecting device is provided which includes an elongated, cylindrical first member having an elongated, laterally open groove and a second member having an opening therethrough with a portion thereof being an eccentric bore. Upon sliding the first member into the eccentric bore, a cable-receiving passage, defined by said groove and bore, may be reduced in diameter upon the relative rotation of the first and second members so that a cable, positioned in the passage, is compressed and retained therein.

BRIEF DESCRIPTION OF THE INVENTION

DESCRIPTION OF THE INVENTION

Figure 1:
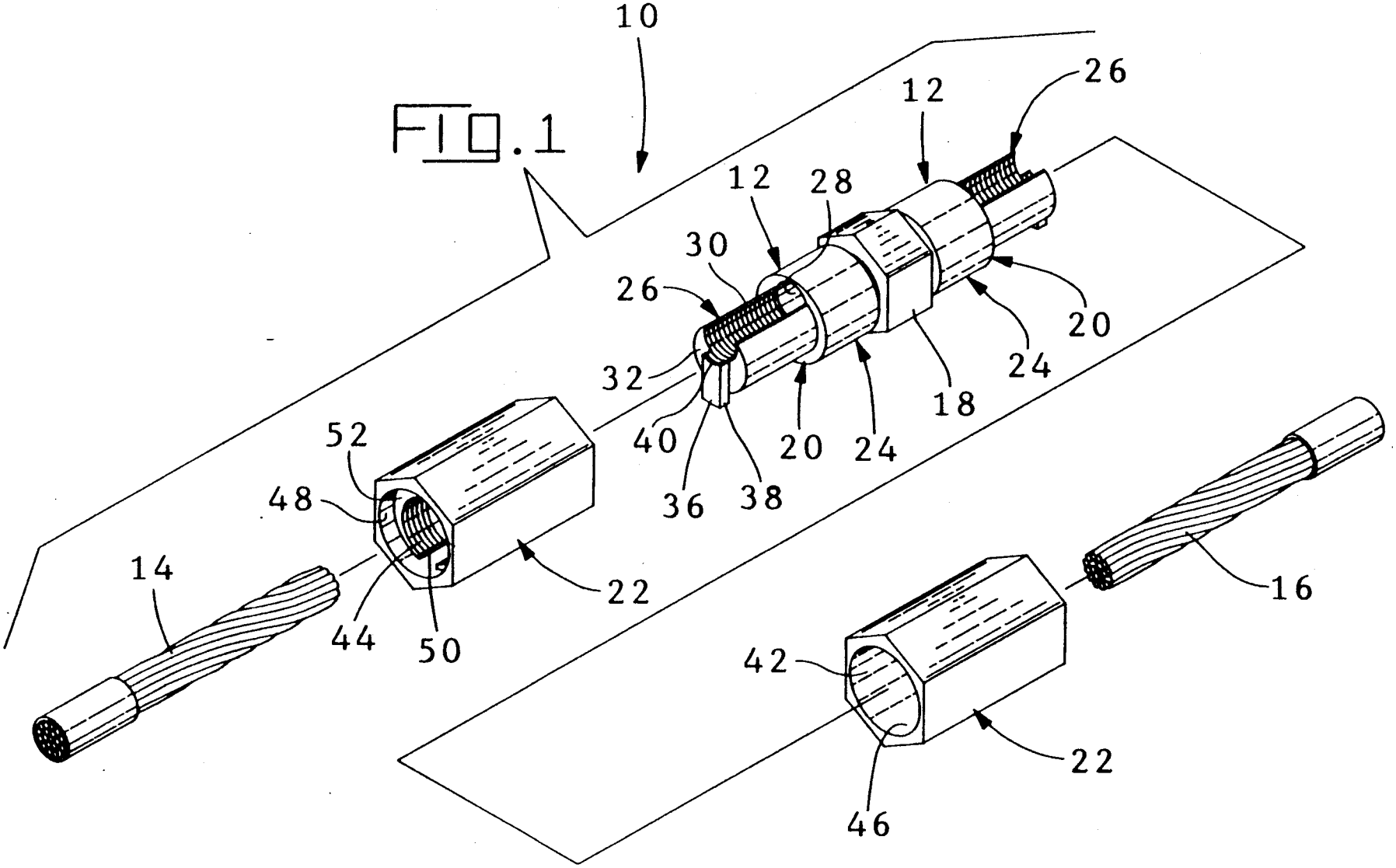
FIG. 1 is an exploded, perspective view of an in-line splice electrical connector having cable connecting devices constructed in accordance with the present invention.

In-line splice 10, shown in the drawings, illustrates one type of an electrical connector in which the present invention; i.e., connecting device 12, may be utilized. In the case of splice 10, a pair of connecting devices 12 are provided for the end-to-end splicing of electrical cables 14,16. Each device 12, attached to respective ends of a hexagonally-shaped center member 18, includes telescoping first member 20 and second member 22.

Figure 2:
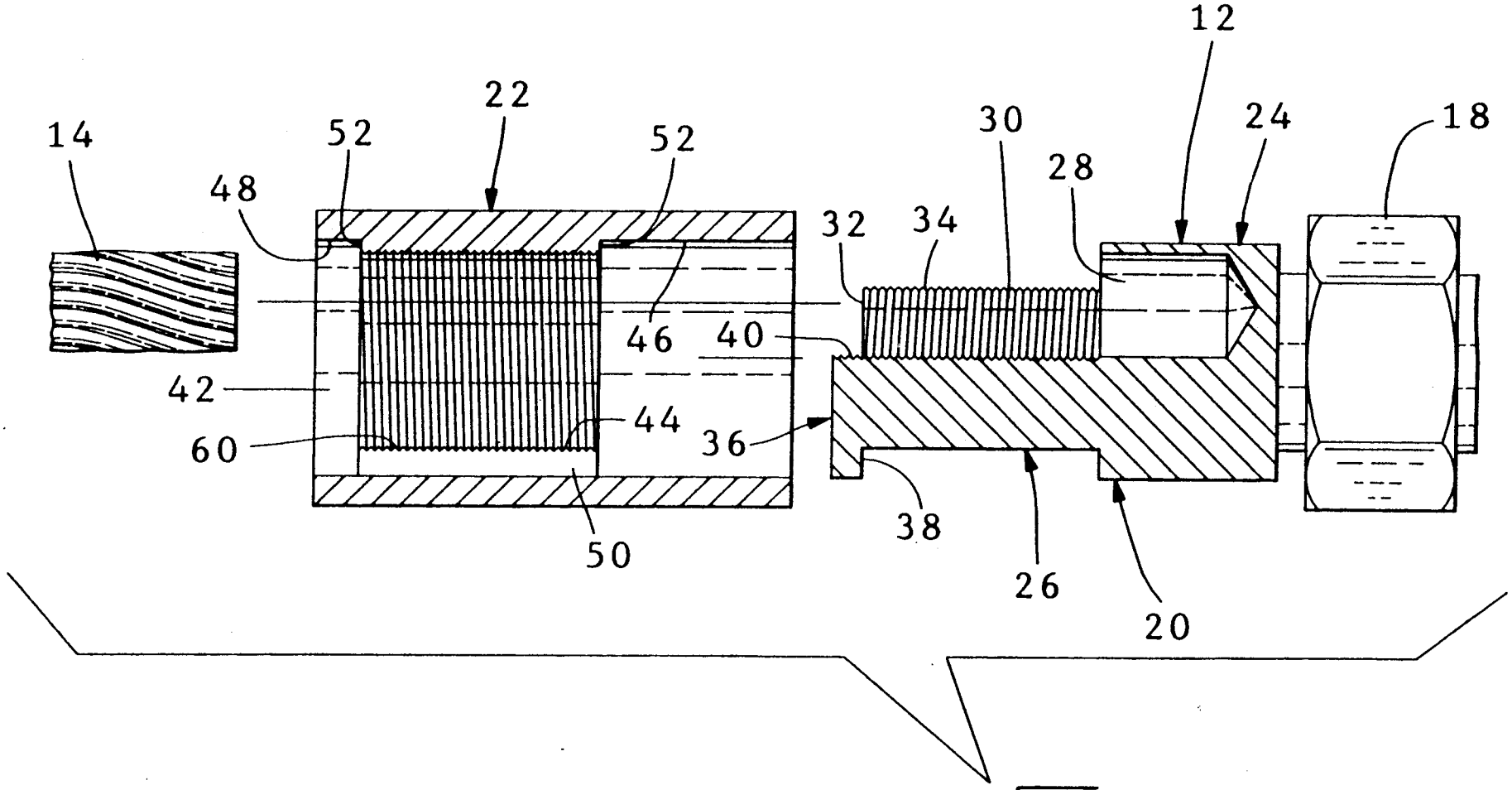
FIG. 2 is an exploded, side sectional view of the components of the connecting device.

With reference to FIG. 2 primarily, first member 20 comprises a first cylindrical section 24 which is adjacent center member 18 and a second cylindrical section 26 extending outwardly from section 24. First section 24 is provided with aperture 28 which opens outwardly as shown.

Second section 26 is provided with a laterally-open groove 30 which joins aperture 28 at one end and is open on free end 32. Serrations 34 are preferably provided on the surface defining groove 30. Second section 2 also includes rectangular block 36 which is attached to free end 32 with one end projecting beyond the periphery thereof to provide tab 38. As shown, tab 38 is located 180 degrees from groove 30. The other end of block 36, indicated by reference numeral 40 is coplanar With groove 30 and is also provided with serrations 34.

Second member 22 is elongated and is provided with opening 42 extending therethrough.

Figure 4:
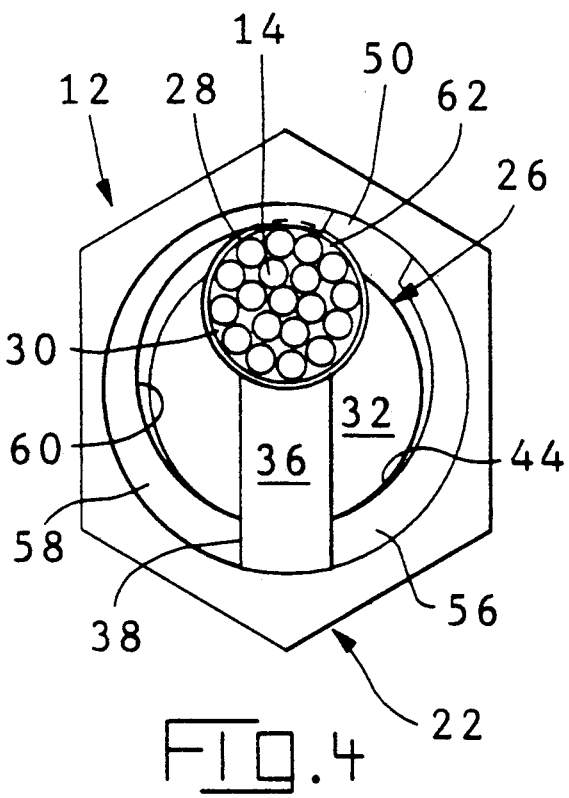
FIG. 4 is an end view of the connecting device taken along lines 4—4 of FIG. 3.

As shown in the sectional view of FIG. 2, eccentric bore 44, first counterbore 46 and second counterbore 48 are defined within opening 42. Bore 44 is provided with elongated slot 50 which communicates with counterbores 46,48. The eccentricity is provided by a non-uniform thickness of elongated, inwardly projecting sleeve 52 defining bore 44; i.e., the radius at one point is shorter or longer than the radius at an opposite point. The end view of member 22 shown in FIG. 4 illustrates the eccentricity. In the preferred pattern, sleeve 52 is thickest in portion 54 located directly opposite and thins towards slot 50. Note that the thickening is greater on side 56 between portion 54 and slot 50 than on opposite side 58. Other patterns providing eccentricity may also be designed to achieve substantially the same results. Bore 44 is serrated as indicated by reference numeral 60.

Figure 3:
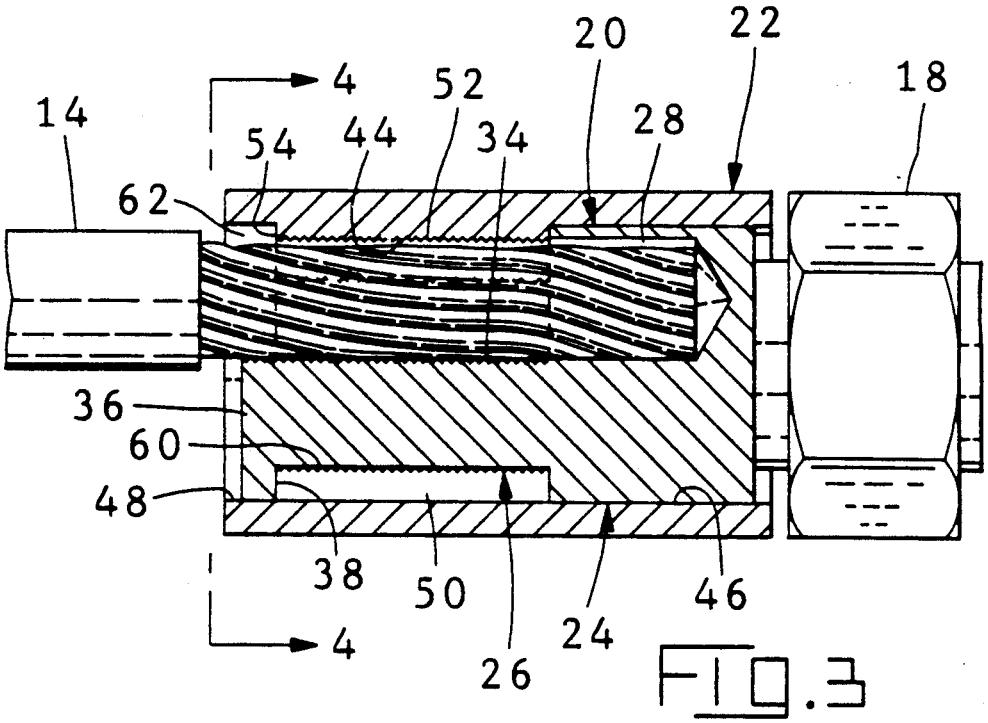
FIG. 3 is a side sectional view of an assembled connecting device with a cable inserted thereinto.
Figure 5:
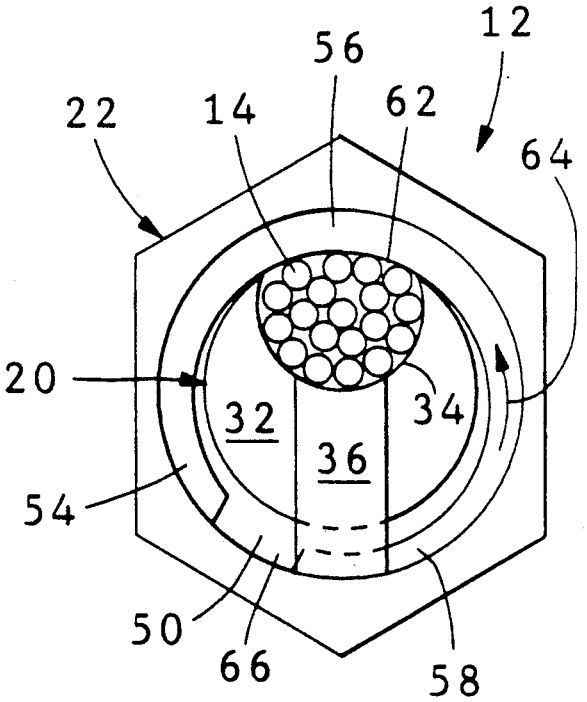
FIG. 5 is also an end view of the connecting device subsequent to the relative rotation of the components to secure the cable therein.

Connecting device 12 is assembled by sliding second member 22 onto first member 20 with tab 38 on block 36 passing through slot 50. As shown in FIG. 3, first counterbore 46 covers first cylindrical section 24, second cylindrical section 26 is within bore 44 and block 36 is located in second counterbore 48. The relative positions of members 20 and 22 as shown in FIGS. 3 and 4 provides the open position of device 12. Passage 62, defined by groove 30 and bore 44, is at its largest diameter with thick portion 54 of sleeve 52 opposite groove 30 as shown in FIG. 4. After cable 14 has been inserted into passage 62 and aperture 28, member 22 is rotated, relative to member 20, either counterclockwise as indicated by arrow 64 in FIG. 5, or clockwise (not shown) as required by the diameter of cable 14. The rotation reduces the diameter of passage 62 resulting in cable 14 being compressed and secured therein. Note that slot 50 is remote from tab 38 which bears against end wall 66 of sleeve 52 facing second counterbore 48. Thus, member 22 cannot be pulled off member 20 without lining tab 38 up with slot 50.

As members 20,22 move relative to each other to reduce the diameter of passage 62, the individual strands of cable 14 move against each other into a tighter fitting relation. The motion removes any oxides and dirt which may be on the strands. Further, serrations 34 and 60 indent cable 14 to provide better electrical continuity therebetween and to assist in retaining the cable in connecting device 12.

As noted above, splice 10 is just one type of electrical connector which can utilize connecting device 12. For example, center member 18 can be replaced by an apertured tongue (not shown) for use on a bus bar or like electrical device.

As can be discerned, an electrical cable connecting device has been disclosed which provides a method of securing a cable by reducing the diameter of the passage receiving the cable. The reduction is achieved by one member being rotatably positioned in an eccentric bore in a second member.

I claim:

1. An electrical cable connecting device, comprising;

an elongated, cylindrical first member having an elongated laterally open groove; and an elongated second member having an opening therethrough with a portion thereof being an eccentric bore, said second member being telescopingly received on said first member with said groove and said bore defining a cable-receiving passage which, when said first and second members are rotated relative to each other, decreases in diameter due to the eccentricity of said bore so that a cable, which may be positioned in said passage, is compressed and securely retained therein.

2. The connecting device of claim 1 wherein said eccentric bore is defined by unequal radii.

3. The connecting device of claim 1 wherein said first member includes a tab at a free end extending beyond the periphery thereof, said tab adapted to engage an end wall of said bore to prevent said first and second members from sliding apart in one direction.

4. The connecting device of claim 3 further including connecting means at another said first member for connecting said connecting device to an electrical device.

5. The connecting device of claim 4 wherein a slot is provided through said bore so that said second member may be slid onto said first member from said free end with said through said slot.

* * * * *

UNITED STATES PATENT AND TRADEMARK OFFICE

CERTIFICATE OF CORRECTION

PATENT NO. : 5,035,660

DATED : July 30, 1991

INVENTOR(S) : Walter M. Werner

It is certified that error appears in the above-identified patent and that said Letters Patent is hereby corrected as shown below:

Claim 4, Column 4, line 12 - insert the word --end of-- after the word "another".

Claim 5, column 4, line 17 - insert the word --tab passing-- before the word "through".

Signed and Sealed this

Fifth Day of January, 1993

*Attest:*

DOUGLAS B. COMER

*Attesting Officer*

*Acting Commissioner of Patents and Trademarks*